US005364199A

United States Patent [19]

Hillmer-Mann

[11] Patent Number: 5,364,199

[45] Date of Patent: Nov. 15, 1994

[54] SHEET FASTENER HINGE DEVICE

[75] Inventor: Eric W. Hillmer-Mann, Kelowna, Canada

[73] Assignee: R. Dale McKenzie, Kelowna, Canada

[21] Appl. No.: 210,736

[22] Filed: Mar. 21, 1994

Related U.S. Application Data

[63] Continuation of Ser. No. 75,898, Jun. 14, 1993, abandoned.

[51] Int. Cl.[5] ..... B42F 3/00; B42F 13/02

[52] U.S. Cl. ..... 402/68; 402/14; 402/75

[58] Field of Search ..... 402/14, 68, 75

[56] References Cited

U.S. PATENT DOCUMENTS

| | | | |
|---|---|---|---|
| 1,987,012 | 1/1935 | Karlen | 402/18 |
| 2,005,717 | 6/1935 | Coulston | 402/14 |
| 2,352,196 | 6/1944 | Hartmann | 402/18 |
| 2,571,044 | 10/1951 | Lynch | 402/17 |
| 4,300,848 | 11/1981 | Waegemann | 402/14 |

*Primary Examiner*—P. W. Echols
*Attorney, Agent, or Firm*—Dalesman & Company

[57] ABSTRACT

A sheet fastener hinge device to removably hinge a second cumulative stack of flexible sheets to a first cumulative stack of flexible sheets. A first elongated panel has a pair of spaced holes or an elongated slot to receive the prongs of a first sheet fastener extending through a pair of apertures spaced adjacent one edge of the sheets in the first stack to removably attach the first panel to the front of the first stack. A second elongated panel has a pair of integral spaced prongs extending therefrom or a pair of spaced holes to receive a second sheet fastener to provide a pair of spaced prongs extending therefrom. The prongs extend through a pair of apertures spaced adjacent one edge of the sheets in the second stack to removably attach the second stack of sheets to the second panel. The second panel is hingedly connected to the first panel, whereby the second stack of sheets pivotable between a closed position in which the second stack of sheets lies against the first stack and an open position in which the two stacks lie in the same plane. In another embodiment, one of the panels can be replaced by a pair of spaced flaps hingedly connected to the remaining panel.

3 Claims, 4 Drawing Sheets

FIG. 3
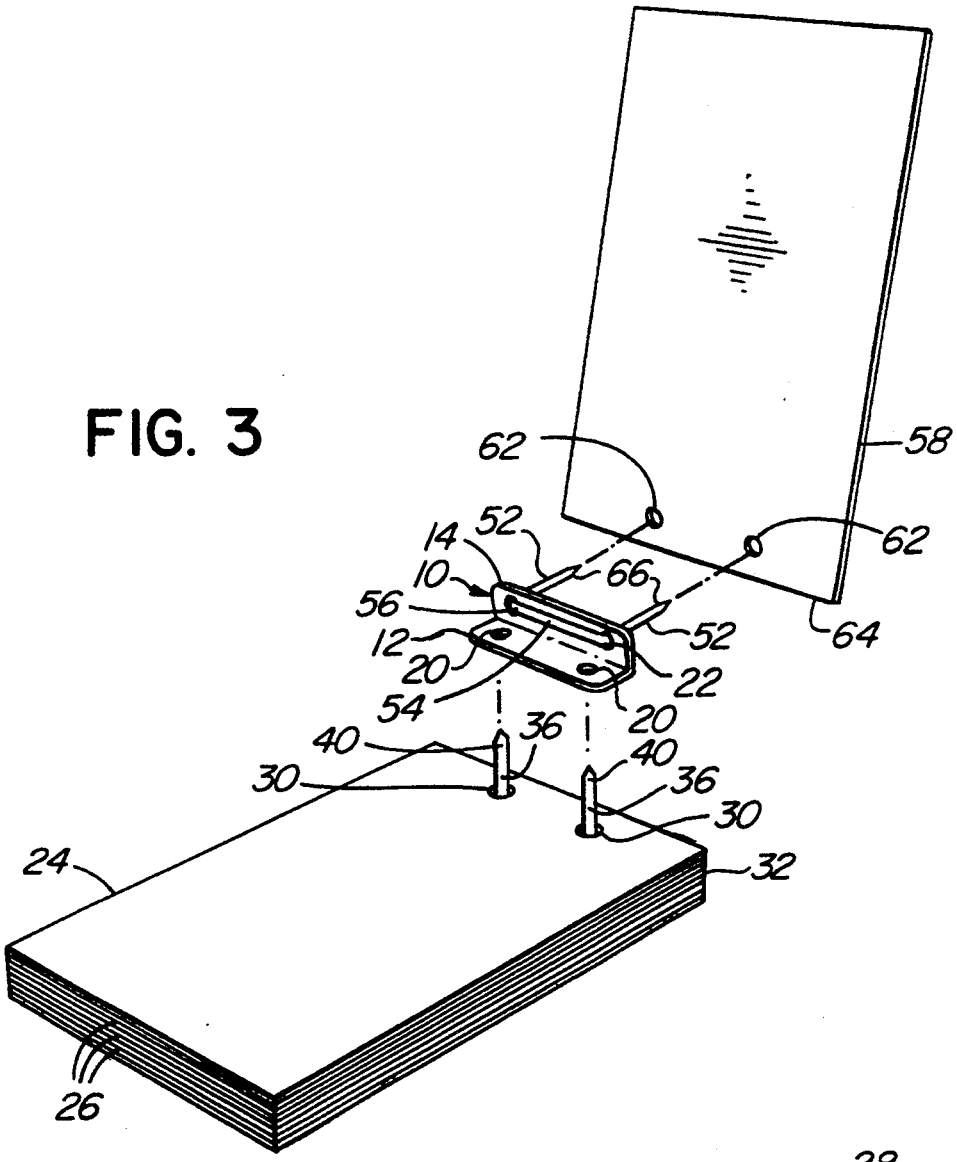
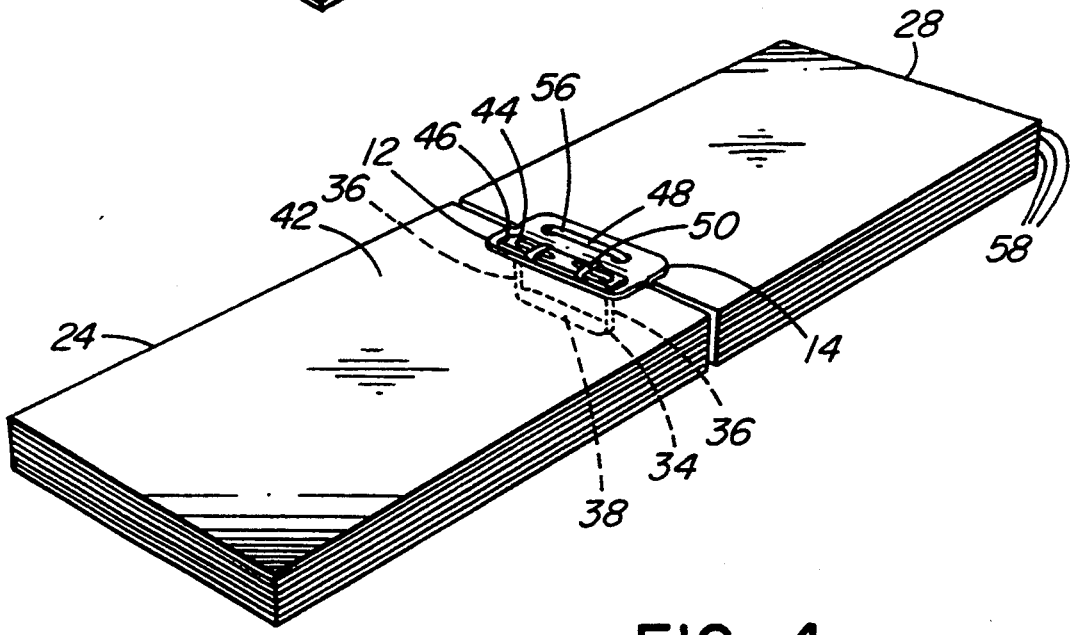
FIG. 4

SHEET FASTENER HINGE DEVICE

This application is a continuation of U.S. patent application Ser. No. 08/075,898, filed on Jun. 14, 1993, now abandoned.

BACKGROUND OF THE INVENTION

This invention relates generally to fasteners cumulatively binding flexible sheets together in a stack, and more particularly to a sheet fastener hinge device to removably hinge a second stack of sheets to a first stack of sheets.

Most office files have thin metal sheet fasteners with a pair of manually bendable prongs extending from an elongated base to cumulatively bind the sheets paper together in a stack. The prongs extend through matching pairs of aligned apertures adjacent one edge of the sheets and outer portions of the prongs are bent over the stacked sheets to securely bind them together adjacent that edge. This allows part of the stack to be lifted up and bent back to see any one of the sheets of paper in the stack. Also, one or more sheets can easily be added to or removed from the stack by first straightening out the outer portions of the prongs and then adding or removing the sheet or sheets. In some cases, an elongated retaining or compressor bar having slidable cross bands is mounted between the prongs on the front of the stack of sheets to more securely retain the bent prongs in place. In some instances, the fastener also extends through a pair of apertures in a file cover to secure the stack of papers to the file cover.

While these existing fasteners are satisfactory for many applications, they have the disadvantage that only a limited number of sheets can be bound in one stack. When the thickness of the cumulative stack of sheets approaches the length of the prongs, the outer portions of the prongs left extending from the stack are not long enough to be bent over to hold the sheets together. Furthermore, when the stack becomes this thick, access to sheets of paper near the rear of the stack becomes quite difficult. Also, it is very inconvenient to add or replace a sheet of paper near the back of the stack as all of the sheets in front of it have to be removed and then replaced.

A device for fastening two stacks of sheets of paper on opposite sides of the spine of a file :folder disclosed in U.S. Pat. No. 1,987,012 to Karlen which issued Jan. 8, 1935. Another attempt to overcome these problems by using interlocking paper fasteners is shown in U.S. Pat. No. 2,571,044 to Lynch which issued Oct. 9, 1951. However, access to the sheets near the back of a thick stack is still very poor. U.S. Pat. No. 2,352,196 to Hartmann which issued Jun. 27, 1944 does show a hinged blank holding a pronged fastener, but it is for securing a single group or stack of sheets in a file folder.

SUMMARY OF THE INVENTION

Accordingly, it is an object of the present invention to at least partially overcome the disadvantages of the prior art by providing a sheet fastener hinge device which allows more sheets to be conveniently secured together by removably hinging a second cumulative stack of flexible sheets to a first cumulative stack of flexible sheets.

Another object of the present invention is to facilitate the addition or replacement of a sheet or sheets near the back of a thick cumulative stack of sheets.

To this end, in one of its aspects, the invention provides a sheet fastener hinge device to be mounted on a first stack of flexible apertured sheets cumulatively bound together adjacent one edge thereof by a first sheet fastener having a first pair of flexible prongs spaced a first predetermined distance apart extending from a first elongated base through first pairs of aligned apertures spaced the first predetermined distance apart adjacent the one edge of the stacked sheets, the sheet fastener hinge device comprising prong receiving means having at least one prong receiving opening therethrough to receive the first pair of prongs extending the first predetermined distance apart therethrough, each of the first pair of prongs having an outer portion which is manually bendable over the prong receiving means to removably attach the sheet fastener hinge device to the first stack of sheets, prong extending means to extend a second pair of flexible spaced prongs therefrom to cumulatively receive and bind a second stack of flexible apertured sheets together adjacent one edge thereof, the second pair of prongs to extend a second predetermined distance apart through second pairs of aligned apertures spaced the second predetermined distance apart adjacent the one edge of the second stack of sheets, and hinge means connecting the prong extending means to the prong receiving means, whereby the second stack of sheets is pivotable around a central pivot axis between a closed position in which the second stack of sheets lies against the first stack of sheets and an open position in which the first and second stacks of sheets lie adjacent each other substantially in a common plane.

Further objects and advantages of the invention will appear from the following description, taken together with the accompanying drawings.

BRIEF DESCRIPTION OF THE DRAWINGS

FIG. 3 is an exploded isometric view showing how the same sheet fastener hinge device attaches a single sheet to a first cumulative stack of sheets, FIG. 4 is a similar isometric view showing a second cumulative stack of sheets hingedly connected to the first stack of sheets.

DESCRIPTION OF THE PREFERRED EMBODIMENTS

Figure 1:
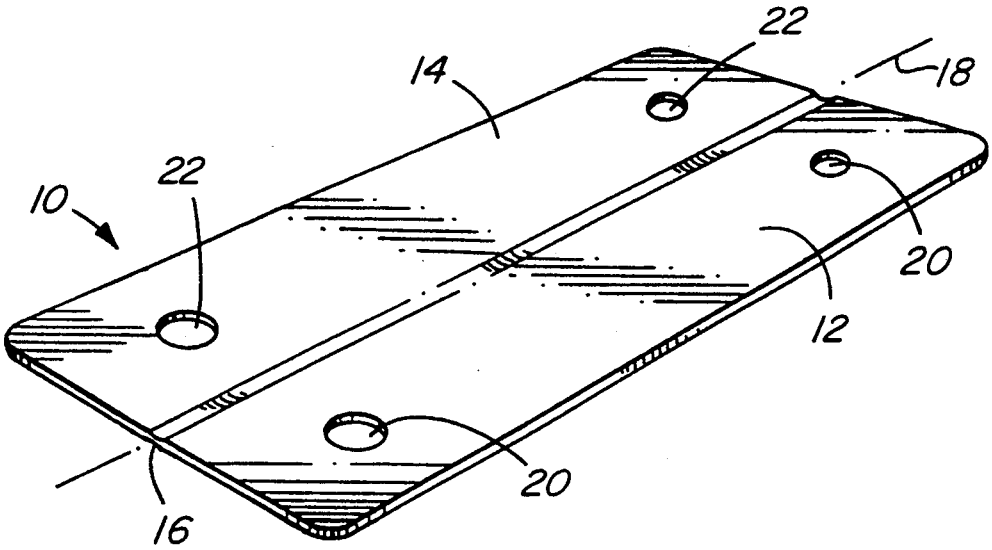
FIG. 1 is an isometric view of a sheet fastener hinge device according to a first embodiment of the invention in the open position.
Figure 2:
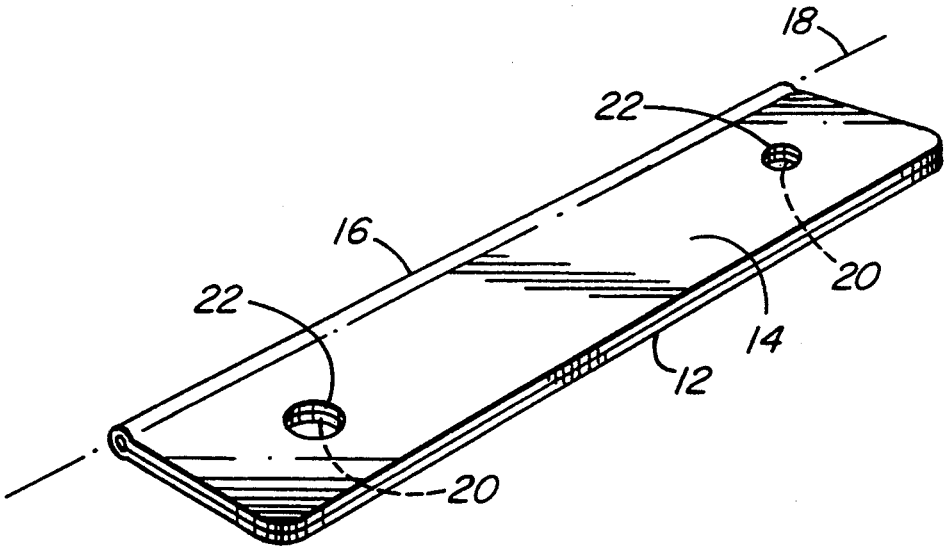
FIG. 2 is an isometric view of the sheet fastener hinge device seen in FIG. 1 in the closed position.

Reference is first made to FIG. 1 and 2 which shows a sheet fastener hinge device 10 according to a preferred embodiment of the invention. In this embodiment, the sheet fastener hinge device 10 has two identical elongated panels 12, 14 connected together by a flexible thin web portion 16 extending along a central pivot axis 18. The flexible thin web portion 16 forms a hinge 16 whereby the second elongated panel 14 is easily pivotable around the central pivot axis 18 between the open position shown in FIG. 1 to the closed position shown in FIG. 2. In this embodiment, the sheet fastener hinge device 10 is made of a suitable plastic material such as polypropylene or polyethylene by injection molding or by coining or stamping an extruded blank to form the living hinge 16 connecting the two elongated panels 12, 14 together. However, in other embodiments it can be laminated or formed of other materials suitable to provide two substantially rigid panels hingedly connected together. Each of the elongated panels 12, 14 has a pair of prong receiving holes 20, 22 therethrough spaced a predetermined distance apart. As seen in FIG. 2, the first pair of holes 20 through the first elongated panel 12 normally match and are aligned in the closed position with the second pair of holes 22 through the second elongated panel 14 to connect two stacks of identical sheets of paper together in a file. However, in other applications connecting two stacks of different types of sheets together, the first and second pairs of holes 20, 22 can be spaced different predetermined distances apart and/or be located different distances away from the central axis 18.

In use, as seen in FIGS. 3 and 4, a sheet fastener hinge device 10 according to the invention is mounted on the first cumulative stack 24 to start a second cumulative stack 28. While this is normally done when the first cumulative stack 24 is becoming too thick, it can also be done to separate different subject matter in a file. While the use of only one sheet fastener hinge device 10 is shown, additional sheet fastener hinge devices can easily be used to provide as many divisions of subject matter as required. The sheets 26 of paper in the first stack 24 have pairs of aligned apertures 30 adjacent the top edges 32 of the sheets 26 which are spaced the same distance apart as the holes 20 through the first elongated panel 12. The first stack 24 of sheets 26 are bound together adjacent the top edges 32 thereof by a sheet fastener 34 having a pair of flexible prongs 36 spaced the same predetermined distance apart extending from an elongated base 38 through the first spaced apertures 30. The sheet fasteners 34 are normally stamped strips of thin steel, but can be made of other materials which are suitably flexible. As is well known, the pairs of apertures 30 in the sheets 26 are normally punched to fit the flexible prongs 36 of the sheet fastener 34, and the first pair of holes 20 through the first elongated panel 12 are made to match the pairs of apertures 30 in the sheets 26. In some cases, the prongs 36 of the sheet fastener 34 also extend through a file cover to attach the first stack 24 of sheets 26 to the file cover, but it is not shown for ease of illustration. Each of the prongs 36 of the sheet fastener 34 has an outer portion 40 which is manually bent over the front 42 of the first stack 24 of sheets 26 to bind them together. In this case, the outer portions 40 of the prongs 36 extend through a pair of spaced holes 44 in an elongated compressor bar 46 and are bent towards each other into a channel 48 in the compressor bar 46. Two retaining bands 50 slide over the outer portions 40 of the prongs 36 to securely retain them in place. In some cases, the compressor bar 46 is not used, and the outer portions 40 of the pair of prongs 36 are bent outwardly over the front 42 of the first stack 24 of sheets 26 to bind them together. Of course, the outer portions 40 of the prongs 36 become shorter as more and more sheets 26 are cumulatively added to the first stack 24.

When the first stack 24 is becoming too thick, the outer portions 40 of the prongs 36 are straightened out and the compressor bar 46 is removed to mount the sheet fastener hinge device 10 according to the invention. The first prong receiving panel 12 is mounted against the front 42 of the first stack 24 with the pair of prongs 36 extending through the pair of holes 20 in the panel 12. The compressor bar 46 is then replaced and the outer portions 40 of the prongs 36 are rebent over the compressor bar 46 and panel 12 to removably attach the sheet fastener hinge device 10 to the first stack 24 of sheets 26.

A pair of prongs 52 similarly extending the same distance apart from the elongated base 54 of another sheet fastener 56 are then inserted through the second pair of holes 22 in the second prong extending panel 14. The prongs 52 extend in a direction away from the first panel 12 in the closed position to cumulatively receive more sheets 58 of paper to form the second stack 28. The prongs 52 extend through a pair of aligned apertures 62 adjacent the top edges 64 of the sheets 58 which are spaced the same distance apart as the holes 22 through the second elongated panel 14, and the outer portions 66 of the prongs 52 are bent over the second stack 28 to bind the sheets 58 of paper together and removably secure them to the second elongated panel 14. Another compressor bar (not shown) can be used or the outer portions 66 of the prongs 52 can be bent directly over the second stack 28 of papers. Thus, the sheet fastener hinge device 10 hingedly connects the second stack 28 of sheets 58 to the first stack 24 sheets 26. The hinge formed by the flexible thin web portion 16 allows the second stack 28 to be easily pivoted around the central pivot axis 18 between the open position wherein the two stacks 24, 28 lie substantially in a common plane as seen in FIG. 4, and the closed position wherein the second stack 28 lies against the front 42 of the first stack 24. Thus, the sheet fastener hinge device 10 can be used to avoid the first stack 24 of sheets 26 growing too thick, and also allows many more sheets to be added if necessary. The second stack 28 of sheets 58 can be pivoted to the open position and the limited thickness of the first stack 24 makes it much easier to bend back part of the stack 24 to provide access to one of the sheets 26 in it. Also, a sheet can more easily be added or replaced in the first stack 24 without also removing all of the sheets 58 in the second stack 28 from the second sheet fastener 56.

Figure 5:
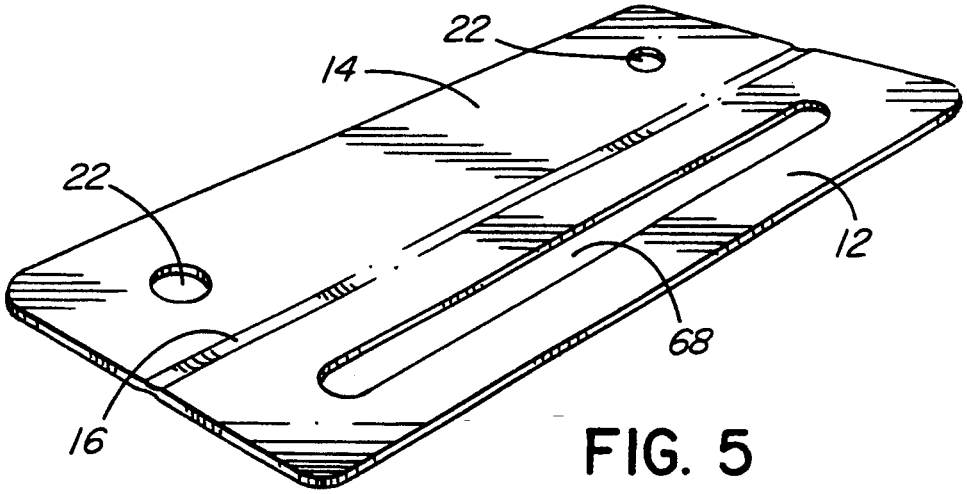
FIG. 5 is an isometric view of a sheet fastener hinge device according to a second embodiment of the invention.
Figure 6:
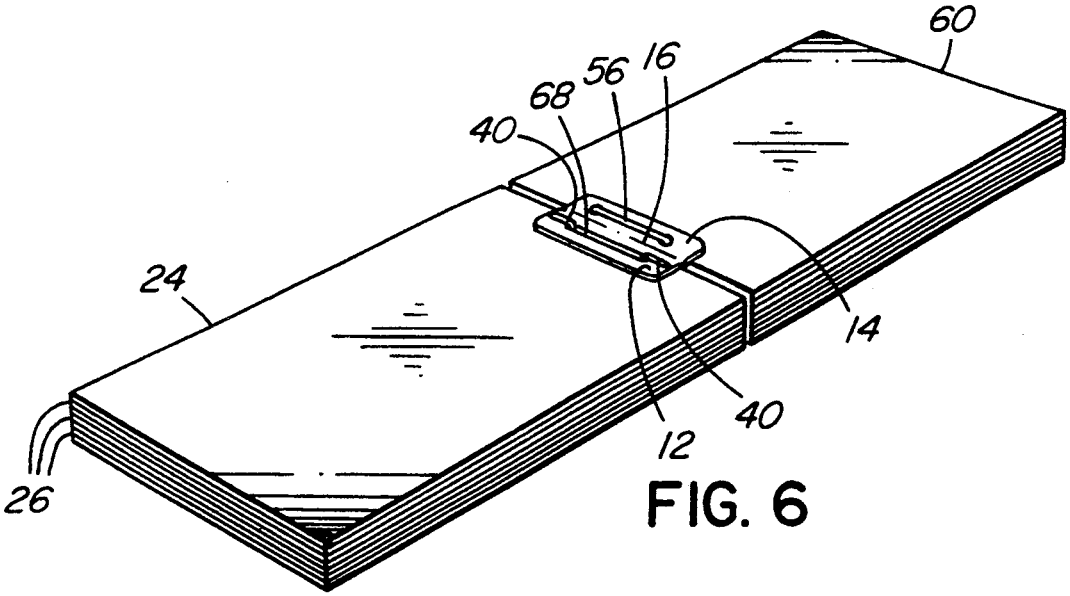
FIG. 6 is an isometric view showing two stacks of sheets hingedly connected together by the sheet fastener hinge device seen in FIG. 5.

The other Figures show other embodiments of the invention, the use of which is similar to that described above and need not be repeated in detail. As many of the elements are the same as those described above, common elements are illustrated and described using the same reference numerals. FIGS. 5 and 6 show a second embodiment of the sheet fastener hinge device 10 in which the first prong receiving panel 12 has a single longitudinal slot 68 rather than a pair of holes therethrough. The slot 68 is the same length as the distance between the pairs of apertures 30 through the sheets 26 of paper to receive the pair of prongs 36 of the first sheet fastener 34 therethrough. Unless a compressor bar is used, the outer portions 40 of the flexible prongs 36 are bent outward as seen in FIG. 6 to removably attach the sheet fastener hinge device 10 to the first stack 24 of sheets 26.

Figure 7:
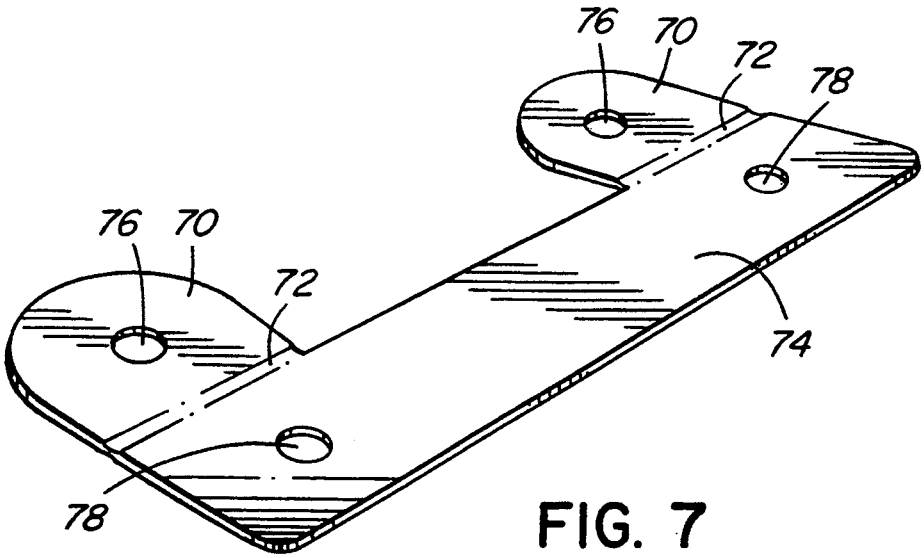
FIG. 7 is an isometric view of a sheet fastener hinge device according to a third embodiment of the invention.

FIG. 7 illustrates another embodiment of the invention in which a pair of spaced flaps 70 are connected by a pair of aligned web portions 72 to an elongated panel 74. The flaps 70 and the panel 74 each have a pair of holes 76, 78 which are spaced apart the same distance as the apertures 30, 62 in the sheets 26, 58 and the prongs 36, 52 of the first and second sheet fasteners 34, 56. The prongs 36 of the first sheet fastener 34 are received through one of the pairs of holes 76 or 78 as described above to attach the sheet fastener hinge device 10 to the first stack 24 of sheets 26. The prongs 52 of the second sheet fastener 56 are then inserted through the other pair of holes 76, 78 to cumulatively receive and secure more sheets 58 to form the second stack 60, as described above.

Figure 8:
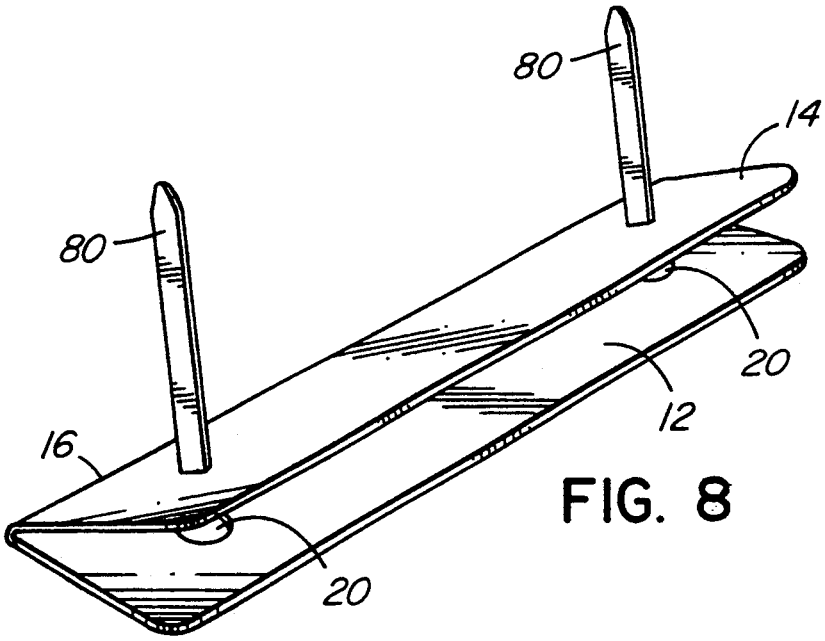
FIG. 8 is an isometric view of a sheet fastener hinge device according to a fourth embodiment of the invention.

The embodiment of the invention shown in FIG. 8 has a pair of flexible prongs 80 which are integrally injection molded to extend from the second elongated panel 14 and are spaced the same distance apart as the pair of holes 20 through the first elongated panel 12. While the sheet fastener hinge device 10 is preferably made of polypropylene, it can also be molded of other plastics such as polyethylene which are suitable to form the living hinge 16 connecting the rigid panels 12, 14 together and also are sufficiently flexible so the prongs 80 can be manually bent over the sheets 58 and retained securely in place by a compressor bar.

Figure 9:
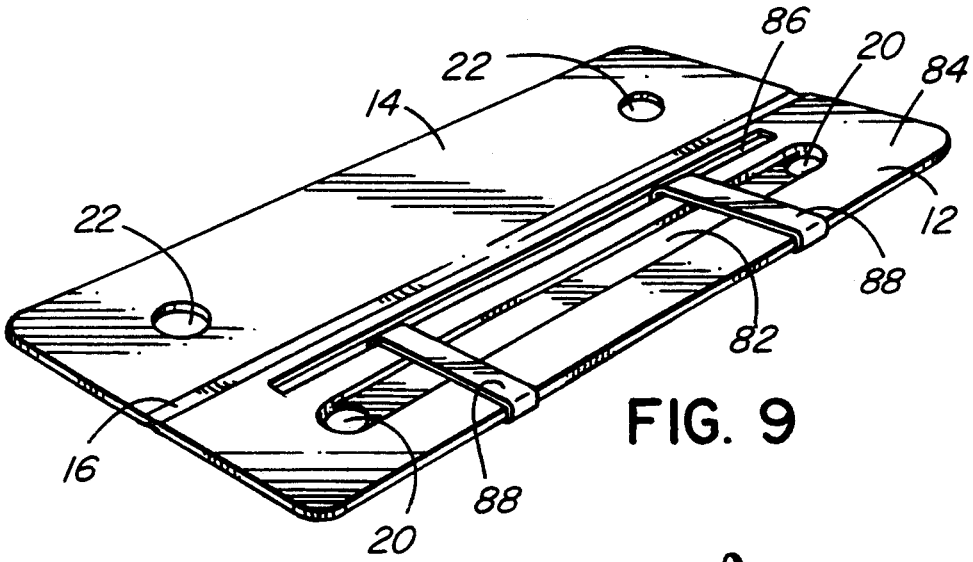
FIG. 9 is an isometric view of a sheet fastener hinge device according to a further embodiment of the invention.
Figure 10:
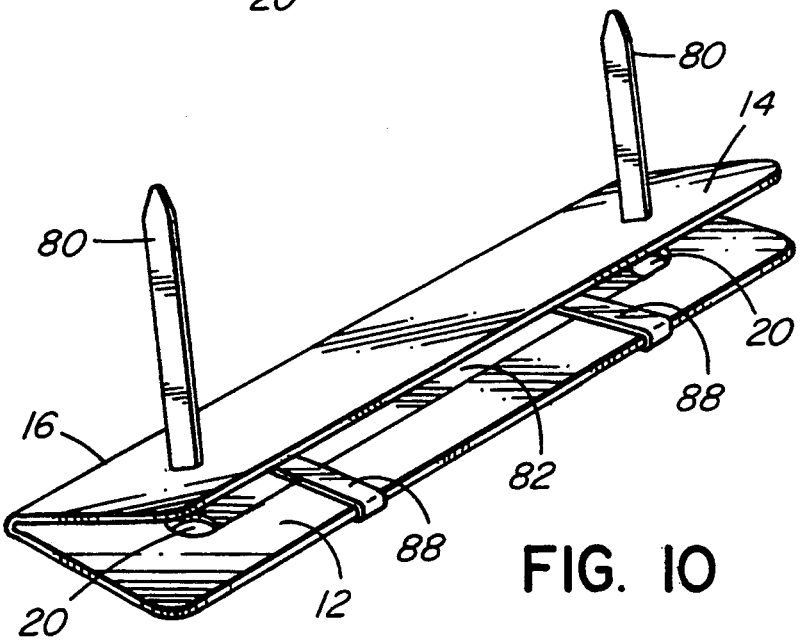
FIG. 10 is an isometric view of a sheet fastener hinge device according to a still further embodiment of the invention.

FIGS. 9 and 10 show other embodiments in which the first elongated panel 12 is made with a prong receiving channel 82 extending in its front surface 84 longitudinally between the first pair of holes 20. The first panel 12 also has a narrow slot 86 therethrough from which a pair of longitudinally slidable prong retaining bands 88 extend across the prong receiving channel 82. As will be appreciated, the bands 88 slide over the outer portions 40 of the prongs 36 of the first sheet fastener 34 after they are bent over into the channel 82 to securely attach the sheet fastener hinge device 10 to the first stack 24 of sheets 26. In the embodiment seen in FIG. 9, the second elongated panel 14 has a pair of spaced holes 22 to receive a second hinge fastener 56 as described above. The second elongated panel 14 of the embodiment seen in FIG. 10 has a pair of spaced prongs 80 extending integrally from it the same as shown in FIG. 8.

While the description of the sheet fastener hinge device according to the invention has been given with respect to several preferred embodiments, it will be evident that various modifications are possible without departing from the scope of the invention as understood by those skilled in the art and as defined in the following claim. For instance, other combinations of prong receiving and prong extending means can be connected by other suitable hinge means. Also, the sheet fastener hinge device can be made of other suitable materials such as cardboard.

The embodiments of the invention in which an exclusive property or privilege is claimed are defined as follows:

1. A sheet filing assembly comprising:

(a) a first stack of matching flexible sheets having a front and a back, the sheets in the first stack each having a first pair of apertures spaced a first predetermined distance apart, the first pairs of apertures being aligned adjacent one edge of the first stack of sheets, (b) a first sheet fastener having a first pair of flexible prongs extending forwardly from a first elongated base, the elongated base extending along the back of the first stack of sheets, the first pair of prongs extending the first predetermined distance apart through the first pair of aligned apertures, (c) a first panel substantially smaller than the flexible sheets and having at least one prong receiving hole therethrough to receive the first pair of prongs of the first sheet fastener therethrough, the first pair of prongs of the first sheet fastener each having an outer portion which is manually bent over the first panel to removably mount the first panel on the front of the first stack of sheets along said one edge thereof, whereby said first stack of sheets are cumulatively bound together adjacent the said one edge thereof.

(d) a second stack of matching flexible sheets having a front and a back, the sheets in the second stack each having a second pair of apertures spaced a second predetermined distance apart, the second pair of apertures being aligned adjacent one edge of the second stack of sheets, (e) a second panel substantially smaller than the flexible sheets, the second panel extending on the back of the second stack of sheets along said one edge of the second stack of sheets, the second panel having a second pair of flexible prongs extending forwardly the second predetermined distance apart through the second pair of apertures, the second pair of flexible prongs each having an outer portion which is manually bent over the front of the second stack of sheets, whereby the second stack of sheets are cumulatively bound together adjacent the said one edge thereof, and (f) narrow hinge means extending parallel to said one edge of the first stack of sheets and to said one edge of the second stack of sheets and connecting the second panel to the first panel, whereby the second stack of sheets is pivotable between a closed position in which the back of the second stack of sheets lies against the front of the first stack of sheets and an open position in which the first and second stacks of sheets lie adjacent each other substantially in a common plane.

2. A sheet filing assembly as claimed in claim 1 wherein the first panel has a first pair of prong receiving holes therethrough spaced the first predetermined distance apart to receive the outer portion of the first pair of prongs of the first sheet fastener therethrough.

3. A sheet filing assembly as claimed in claim 2 wherein the second panel has a second pair of prong receiving holes therethrough spaced the second predetermined distance apart, and comprising a second sheet fastener having a second elongated base and the second pair of flexible prongs extending forwardly therefrom through the second pair of prong receiving holes in the second panel and through the second pairs of apertures in the sheets in the second stack of sheets, the outer portion of the second pair of flexible prongs being manually bent over the front of the second stack of sheets to removably attach the second stack of sheets to the second elongated panel.

* * * * *